United States Patent [19]

Kobayakawa et al.

[11] 4,132,920

[45] Jan. 2, 1979

[54] LUMINESCENT DISPLAY PANEL HAVING A TRANSPARENT AND CONDUCTIVE FILM MAINLY ON A WINDOW INSIDE SURFACE OF A GLASS COVER AND A METHOD OF MANUFACTURING THE SAME

[75] Inventors: Masaki Kobayakawa; Kazufumi Yawata; Kiyoshige Hirano; Shigeru Yamashita, all of Izumi, Japan

[73] Assignee: Nippon Electric Kagoshima, Japan

[21] Appl. No.: 752,893

[22] Filed: Dec. 21, 1976

[30] Foreign Application Priority Data

Dec. 22, 1975 [JP] Japan ..... 50-153019

[51] Int. Cl.[2] ..... H01J 9/20; H01J 63/02; H01J 63/06

[52] U.S. Cl. ..... 313/497; 313/220; 313/313; 313/513; 427/64; 29/25.11

[58] Field of Search ..... 313/496, 497, 513, 519, 313/313, 220; 427/64; 29/25.11

[56] References Cited

U.S. PATENT DOCUMENTS

| | | | |
|---|---|---|---|
| 3,571,655 | 3/1971 | Tanimoto | 313/497 X |
| 4,004,186 | 1/1977 | Bylander | 313/513 X |
| 4,023,876 | 5/1977 | Fukunaga et al. | 313/497 X |
| 4,045,703 | 8/1977 | Mori et al. | 313/513 X |

*Primary Examiner*—Palmer C. Demeo

*Attorney, Agent, or Firm*—Hopgood, Calimafde, Kalil

[57] ABSTRACT

A luminescent display panel comprises a planar anode assembly comprising luminescent anode segments. A glass cover has peripheral flange portions surrounding a window area. So as to enclose a vacuum space, the flange portions are hermetically sealed to the anode assembly by a frit glass layer together with lead-out conductors arranged along at least one particular flange portion for the anode segments, at least one grid, and at least one hot cathode. A transparent and electroconductive film is formed mainly on an inside surface of the window area. The film may be formed also on the flange portions. If formed, the film portion formed on the particular flange portion should have a higher electric resistance than the electroconductive film portion. For example, the resistances should be 10 MΩ or more between two adjacent lead-out conductors for the anode segments, 1 MΩ or more between two adjacent conductors for the grids, an anode segment conductor and an adjacent grid conductor, and an anode segment conductor and an adjacent cathode conductor, and 100 kΩ or more between a grid conductor and an adjacent cathode conductor. On forming the electroconductive film, the particular flange portion may be either covered by a metal cover or preliminarily coated with a powder material which can be removed after formation of the film.

10 Claims, 3 Drawing Figures

LUMINESCENT DISPLAY PANEL HAVING A TRANSPARENT AND CONDUCTIVE FILM MAINLY ON A WINDOW INSIDE SURFACE OF A GLASS COVER AND A METHOD OF MANUFACTURING THE SAME

BACKGROUND OF THE INVENTION

This invention relates to a luminescent display panel, namely, a fluorescent or phosphorescent display panel, which comprises a substantially planar anode assembly, a glass cover having integral peripheral flange portions hermetically sealed to the anode assembly, and a plurality of lead-out conductors hermetically sealed between the assembly and the glass cover along at least one of the flange portions. This invention relates also to a method of manufacturing a luminescent display panel of the type described.

A recent luminescent display panel is usually for a plurality of displays or digits. Each digit, as called herein, may be a numeral, a letter, a symbol, or the like. The display panel comprises a substantially planar anode assembly and a glass cover having integral peripheral flange portions hermetically sealed to the assembly by an interposed layer of fused frit glass. Within a vacuum space enclosed by the hermetically sealed anode assembly and glass cover, the display panel comprises a plurality of luminescent anode segments comprised by the assembly for the respective digits, at least one hot cathode over the anode segments, and a grid between the cathode and the anode segments for each digit. The display panel further comprises lead-out conductors for electrically leading the anode segments, cathode, and grids outwardly of the vacuum space. As will later be described, the lead-out conductors are arranged along at least one of the flange portions and hermetically sealed in that portion of the frit glass layer which is interposed between the assembly and the last-mentioned flange portion.

A luminescent display panel of the type described further comprises a transparent and electroconductive film on that surface of the glass cover which faces the anode assembly and is herein called an inside surface for brevity. It may be mentioned here that the display panel is put into operation by making the cathode emit thermal electrons and by selectively supplying electric voltages to the anode segments and the grids by an external or peripheral electric circuit so as to make the electrons bombard the selected anode segments and that the display panel is usually placed together with the peripheral circuit in a casing having a transparent window plate for allowing the displays to be viewed therethrough. The film serves as means for preventing accumulation of stray electrons and other charges on the inside surface with one end of each cathode brought into electric contact therewith through a support therefor and also as an electrostatic shield for shielding the display panel from electric charges which inevitably accumulate on the casing window plate. The film is therefore more effective when the resistivity thereof is rendered lower. Attempts have therefore been directed to reduction of the film resistivity. On the other hand, it has been usual on sealing the glass cover to the anode assembly to press them together so as to avoid formation of pin holes through the frit glass layer along the lead-out conductor portions sealed in the frit glass layer. Some or all of the lead-out conductors are therefore liable to come into substantial electric contact at least partially with the film portion formed on the flange inside surface to be undesiredly shorted by the film portion and to thereby adversely affect the yield of the luminescent display panels.

SUMMARY OF THE INVENTION

It is therefore a general object of the present invention to provide a luminescent display panel for which the yield of manufacture is high.

It is another general object of this invention to provide a method of manufacturing luminescent display panels with a high yield.

It is a specific object of this invention to provide a luminescent display panel wherein a transparent and electroconductive film formed on an inside surface of a glass cover will never come into substantial electric contact with lead-out conductors for the display panel electrodes.

It is another specific object of this invention to provide a method of manufacturing a luminescent display panel wherein a transparent and electroconductive film formed on an inside surface of a glass cover will never come into substantial electric contact with lead-out conductors for the display panel electrodes.

According to this invention, there is provided a luminescent display panel which comprises a substantially planar anode assembly comprising a plurality of luminescent anode segments, a glass cover having integral peripheral flange portions and a window area surrounded by the flange portions, and a frit glass layer hermetically sealing the anode assembly and the flange portions together to enclose a vacuum space in cooperation with the anode assembly and the glass cover with the anode segments directed towards the vacuum space. The display panel further comprises at least one hot cathode within the vacuum space and over the anode segments, at least one grid also within the vacuum space between the cathode and the anode segments, and a plurality of lead-out conductors for the anode segments, the cathode, and the grids. The lead-out conductors are hermetically sealed in the frit glass layer along at least one of the flange portions. The display panel still further comprises a transparent and electroconductive film substantially only on that surface of the window area which faces the anode assembly. The transparent and electroconductive film is capable of serving as means for preventing accumulation on the window area surface of electrons emitted by the cathode.

DESCRIPTION OF THE PREFERRED EMBODIMENTS

Figure 1:
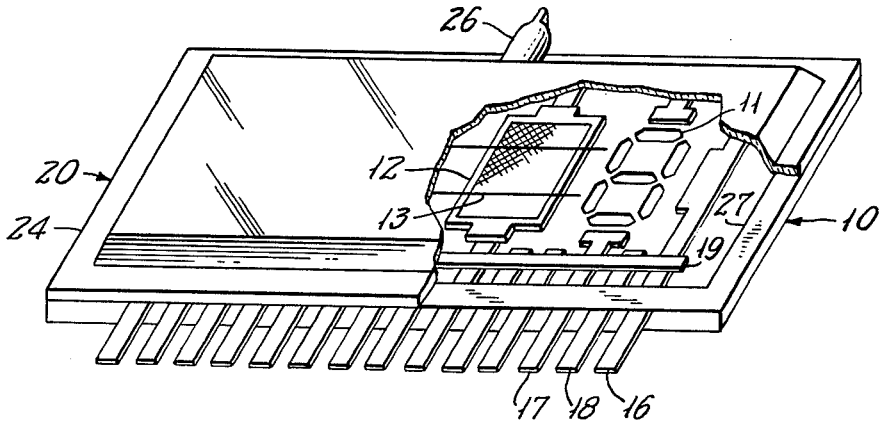
FIG. 1 is a schematic perspective view, partly cut away, of a luminescent display panel in general.

Referring at first to FIG. 1, a typical multi-digit luminescent display panel comprises a substantially planar anode assembly 10 comprising, in turn, a substrate of an insulator material, such as glass or ceramics, a plurality of anode leads (not shown) thereon, an insulator layer made integral with the substrate to cover the anode leads with through holes formed at predetermined positions, and a plurality of luminescent anode segments 11 for the respective digits in predetermined ones of the through holes in electric contact with the anode leads as exemplified in U.S. Pat. No. 3,849,686 issued to Togo MIYAZAKI. A grid 12 for the anode segments 11 of each digit and at least one hot cathode 13 extended over the grids 12 are fixed to a frame comprising a plurality of metal plates 16 for the anode segments 11, a plurality of similar metal plates 17 for the respective grids 12, and a pair of like metal plates 18 for the respective ends of each cathode 13 to provide a metal-plate assembly, which is put on the insulator layer and fixed thereto by a mass 19 of fused frit glass. The metal plates 16–18 are preferably of a nickel-chromium-iron alloy consisting essentially of 42% by weight of nickel, 6% by weight of chromium, and 52% by weight of iron. The metal plates 16 for the anode segments 11 are brought into electric contact with the respective anode leads through the remaining ones of the through holes.

Figure 2:
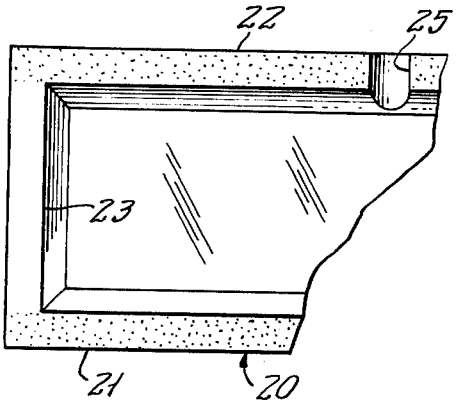
FIG. 2 is a fragmentary bottom view of a glass cover for use in a luminescent display panel, such as shown in FIG. 1, according to a preferred embodiment of the present invention.

Referring now to FIG. 2, a glass cover 20 for use in the display panel illustrated with reference to FIG. 1 has four integral peripheral flange portions 21, 22, 23, and 24 conforming in general outline to the anode assembly 10. The glass cover 20 further has an indent 25 for an exhaust pipe 26 (FIG. 1) and a window area surrounded by the flange portions 21–24 for enabling the displays given by pertinent ones of the anode segments 11 to be viewed therethrough. Stated more in detail, the window area is surrounded by the flange portions 21–24 together with intermediate slanting areas connecting the window area and the respective flange portions 21–24. The intermediate areas may be deemed as parts of the window area.

Referring back to FIG. 1, the flange portions 21–24 are hermetically sealed to the anode assembly 10 by a layer 27 of fused frit glass so as to enclose a vacuum space in which the grids 12 and the cathode 13 are placed with the anode segments 11 directed towards the vacuum space. The metal plates 16–18 are hermetically sealed in the frit glass layer 27 along at least one of the flange portions 21–24, such as a particular flange portion 21, to serve as lead-out conductors 16–18 for electrically leading the anode segments 11, grids 12, and cathode 13 outwardly of the vacuum space. Before sealed, the glass cover 20 is provided with a transparent and electroconductive film on the inside surface for the purposes set forth in the preamble of the instant specification. In accordance with one of known methods that is preferred in manufacturing luminescent display panels, the film is formed by spraying tin chloride solution onto the inside surface of the glass cover 20 preliminarily heated. Various other metal compounds and methods are known in the art of manufacturing the film.

As best shown in FIG. 2, a glass cover 20 for use in a luminescent display panel according to a preferred embodiment of the present invention has the transparent and electroconductive film substantially only on the inside surface of the window area. The inside surfaces of the flange portions 21–24 may also be covered with the material for the transparent and electroconductive film. It is, however, important according to this invention that a resistive film portion, as named herein, formed on the inside surface of the particular flange portion 21 should have a higher electric resistance than the transparent and electroconductive film. For example, the resistance of the resistive film should be 10 MΩ or more per a pitch of, for example, 2.54 mm between two adjacent ones of equally spaced lead-out conductors 16–18 while the resistance of the transparent and electroconductive film should be 1 MΩ or less per pitch. It has now been confirmed that the resistive film astonishingly prevents the lead-out conductors 16–18 from being undesiredly shorted.

Figure 3:
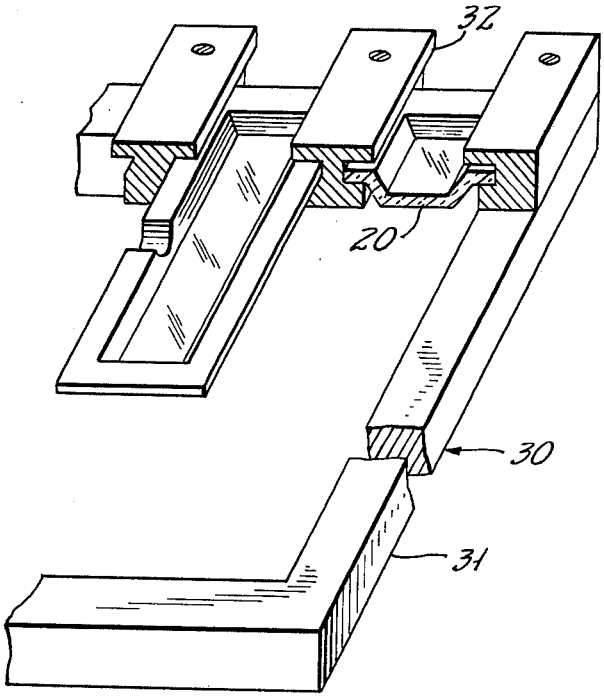
FIG. 3 schematically shows a partial perspective view of a "tray" for putting a method according to a first embodiment of this invention into effect, together with a few glass covers on a reduced scale.

Referring now to FIG. 3, a glass cover 20 for use in a luminescent display panel according to this invention may be manufactured by a method according to a first embodiment of this invention by the use of a "tray" 30 for carrying a plurality of similar glass covers, such as 20. With at least one "tray," such as 30, coupled to a conveyor (not shown), the material for the transparent and electroconductive film is sprayed onto the heated glass cover inside surface. It may be pointed out here that a multi-digit luminescent display panel usually has a general outline of an elongated rectangle or parallelogram and that the flange portions 21–24 accordingly consist of a pair of longitudinal flange portions 21–22 and another pair of transverse flange portions 23–24 connecting the longitudinal flange portions 21–22. It is understood from FIG. 1 that the lead-out conductors 16–18 of the typical display panel are arranged along at least one of the longitudinal flange portions 21–22 having inside surface areas designated by dots in FIG. 2. Preferably, the "tray" 30 comprises a rectangular frame 31 composed of four iron or other metal beams and a plurality of iron or other metal "rails" or covers 32 for supporting the glass covers at their longitudinal flange portions and for covering the longitudinal flange portions from the sprayed metal compound solution. In the illustrated example, each "rail" 32 is provided with a groove for receiving the longitudinal flange 21 or 22, which may have a "projection" described in U.S. patent application Ser. No. 670,532 filed Mar. 25, 1976, by Takashi YAMAUCHI, now U.S. Pat. No. 4,034,253. With the width and depth of the groove empirically decided, it has been confirmed that the illustrated "rails" 32 will serve to restrict the transparent and electroconductive film of each glass cover 20 substantially only to the inside surface of the window area and to render the resistive films formed on the dotted areas sufficiently resistive. Stated more in detail, it will be seen that the transparent and electroconductive film is formed on the inside surfaces of the transverse flange portions 23–24. Although it is sufficient that only flange portion 21 which abuts lead-out conductors 16–18 be rendered relatively resistive with respect to the electroconductive layer, a higher production efficiency will be attained if both flange portion 21 and 22 are made more resistant at the same time. In any event, it is seen that, the electro-conductive layer and the relatively resistant layer are simultaneously formed during the spraying step.

A glass cover 20 for use in a luminescent display panel according to this invention may also be manufactured by a method according to a second embodiment of the invention comprising the steps of applying a powder material onto the inside surface of the particular flange portion 21 prior to the spraying step and substantially removing the powder material applied to the particular flange portion inside surface after the spraying step by the use of a solvent that dissolves the powder material. Conventional solvent therefor does not attack the transparent and electroconductive film. It is therefore possible to provide a relatively resistive film on the particular flange portion, such as 21, despite the fact that the powder material is covered with the electroconductive film sprayed or otherwise formed on the powder material. As the powder is removed by the solvent as described below, a substantial portion of the conductive film will also be removed rendering it relatively resistant. A preferred powder material is calcium sulfate powder mixed with a small amount, such as about 10% by weight or less, of magnesium oxide powder. Use may be made of magnesium oxide powder alone. As will readily be understood, a solvent for these powder materials may be a nitric acid solution of a concentration of about 10%. It is preferred to wash the glass cover 20 in an ultrasonic water bath after the spraying step and before the powder material dissolving step and to rinse the glass cover 20 with water after substantially removing the powder material by the solvent. Alternatively, the glass cover 20 for a luminescent display panel according to this invention may be manufactured by forming the transparent and electroconductive film on the whole inside surface of the glass cover 20 and thereafter grinding or otherwise mechanically removing the film away at least by a thickness at the inside surface of the particular flange portion 21. Chemical etching of the film at the particular flange portion inside surface may be resorted to although it is somewhat troublesome at present to protect the film against the etchant substantially at the inside surface of the window area.

It should be pointed out that the above-mentioned resistance of 10 MΩ or more for the resistive film gives in effect the insulation between the display panel electrodes 11–13. Although preferred values of the insulation depend on the peripheral circuit, it has been decided for various conventional peripheral circuits that the insulation should be about 10 MΩ or more between two adjacent lead-out conductors 16 for the anode segments 11, about 1 MΩ or more between two adjacent lead-out conductors 17 for the grids 12, between a lead-out conductor 16 for the anode segments 11 and an adjacent grid lead-out conductor 17, and between a lead-out conductor 16 for the anode segments 11 and an adjacent cathode lead-out conductor 18, and about 100 kΩ or more between a grid lead-out conductor 17 and an adjacent cathode lead-out conductor 18.

What is claimed is:

1. A luminescent display panel which comprises:

a substantially planar anode assembly comprising a plurality of luminescent anode segments;

a glass cover having integral peripheral flange portions and a window area surrounded by said flange portions;

a frit glass layer hermetically sealing said anode assembly and said flange portions together to enclose a vacuum space in cooperation with said anode assembly and said glass cover with said anode segments directed towards said vacuum space;

at least one hot cathode within said vacuum space and over said anode segments;

at least one grid also within said vacuum space between said cathode and said anode segments;

a plurality of lead-out conductors for said anode segments, said cathode, and said grid, said lead-out conductors being hermetically sealed in said frit glass layer along at least one of said flange portions; and a transparent and electroconductive film on the surface of said window area which faces said anode assembly, said transparent and electroconductive film capable of serving as a means for preventing accumulation on said surface of electrons emitted by said cathode, said electroconductive film having a portion substantially more resistant on at least one of said flange portions to prevent electrical conduction between said lead-out conductors.

2. A luminescent display panel as claimed in claim 1, said flange portions consisting of a pair of longitudinal flange portions and a pair of transverse flange portions connecting said longitudinal flange portions, said lead-out conductors being arranged along one of said longitudinal flange portions, said more resistant portions being located at said longitudinal flange portions.

3. A luminescent display panel as claimed in claim 1, wherein said substantially more resistant portion has an electric resistance of at least about 10 MΩ between each adjacent pair of said lead-out conductors.

4. A luminescent display panel as claimed in claim 1, wherein said substantially more resistant portion has an electric resistance of at least about 10 MΩ between each adjacent pair of the lead-out conductors for the anode segments, at least about 1 MΩ between each adjacent pair of the lead-out conductors or the grids, between one of the lead-out conductors for the anode segments and an adjacent one of the lead-out conductors for the grids, and between one of the lead-out conductors for the anode segments and an adjacent one of the lead-out conductors for the cathode, and at least 100 kΩ between one of the lead-out conductors for the grids and an adjacent one of the lead-out conductors for the cathode.

5. A luminescent display panel as claimed in claim 1, wherein said substantially more resistant portion comprises a thinner coating of said electroconductive film.

6. A method of manufacturing the luminescent display panel of claim 1, comprising the step of forming said transparent and electroconductive film substantially only on said window area surface.

7. A method as claimed in claim 6, wherein said film forming step comprises the step of simultaneously forming a resistive film on that surface of said at least one flange portion which faces said anode assembly, said resistive film being made of a substantially same material as said transparent and electroconductive film but having a higher electric resistance than said transparent and electroconductive film.

8. A method as claimed in claim 6, said flange portions consisting of a pair of longitudinal flange portions and a pair of transverse flange portions connecting said longitudinal flange portions, said lead-out conductors being arranged along one of said longitudinal flange portions, wherein said film forming step comprises the step of simultaneously forming a pair of resistive films on those surfaces of said longitudinal flange portions which face said anode assembly, said resistive films being made of a substantially same material as said transparent and electroconductive film but having a higher electric resistance than said transparent and electroconductive film.

9. A method as claimed in claim 8, wherein said resistive film forming step comprises the step of preliminarily covering said longitudinal flange portion inside surfaces with a pair of metal covers prior to said transparent and electroconductive film forming step whereby said resistive films are formed simultaneously with said transparent and electroconductive film.

10. A method as claimed in claim 6, wherein said resistive film forming step comprises the steps of applying a powder material onto said at least one flange portion surface prior to said transparent and electroconductive film forming step and of substantially removing said powder material preliminarily applied to said at least one flange portion surface after said transparent and electroconductive film forming step by the use of a solvent, said powder material being dissolved in said solvent, whereby said resistive film is formed substantially simultaneously with said transparent and electroconductive film.

* * * * *

UNITED STATES PATENT OFFICE

CERTIFICATE OF CORRECTION

Patent No. 4,132,920 Dated January 2, 1979

Inventor(s) Kobayakawa, M., Yawata, K., Hirand, K., Yamashita,S.

It is certified that error appears in the above-identified patent and that said Letters Patent are hereby corrected as shown below:

Claim 4, line 6 change "or" to --for--

Signed and Sealed this

*Third* Day of *July 1979*

[SEAL]

*Attest:*

*Attesting Officer*

LUTRELLE F. PARKER

*Acting Commissioner of Patents and Trademarks*